US011401642B2

(12) United States Patent
Matten

(10) Patent No.: US 11,401,642 B2
(45) Date of Patent: Aug. 2, 2022

(54) TOOL FOR SUPPORTING A WORKPIECE ON AN EMBROIDERY MACHINE

(71) Applicant: CreateMe Technologies LLC, New York, NY (US)

(72) Inventor: David Bennet Matten, Mountain View, CA (US)

(73) Assignee: CreateMe Technologies LLC, New York, NY (US)

( * ) Notice: Subject to any disclaimer, the term of this patent is extended or adjusted under 35 U.S.C. 154(b) by 0 days.

(21) Appl. No.: 17/561,474

(22) Filed: Dec. 23, 2021

(65) Prior Publication Data

US 2022/0145506 A1 May 12, 2022

Related U.S. Application Data

(63) Continuation-in-part of application No. 17/549,507, filed on Dec. 13, 2021, which is a continuation of application No. 17/093,579, filed on Nov. 9, 2020, now Pat. No. 11,198,963.

(51) Int. Cl.

| | |
|---|---|
| ***D05C 1/04*** | (2006.01) |
| ***D05C 9/04*** | (2006.01) |
| ***B65D 25/54*** | (2006.01) |
| ***B65D 85/00*** | (2006.01) |
| ***B65D 25/00*** | (2006.01) |
| *B65D 85/18* | (2006.01) |

(52) U.S. Cl.

CPC ..... *D05C 1/04* (2013.01); *B65D 25/005* (2013.01); *B65D 25/54* (2013.01); *B65D 85/70* (2013.01); *D05C 9/04* (2013.01); *B65D 85/182* (2013.01)

(58) Field of Classification Search

CPC ..... D05C 1/04; D05C 9/04; B65D 25/005; B65D 25/54; B65D 85/70; B65D 85/182; D05B 39/00; D05B 3/243; D05B 19/16; D05B 21/00

See application file for complete search history.

(56) References Cited

U.S. PATENT DOCUMENTS

| | | | | |
|---|---|---|---|---|
| 4,998,964 A * | 3/1991 | Golia | D05B 21/00 | 112/318 |
| 6,065,413 A * | 5/2000 | Kawaguchi | D05C 9/04 | 112/470.14 |
| 6,119,609 A * | 9/2000 | Kawaguchi | D05C 9/04 | 112/103 |
| 10,689,786 B2 * | 6/2020 | Schwarzberger | D05B 19/12 | |
| 2009/0013913 A1 * | 1/2009 | Nonobe | D05B 3/243 | 112/260 |

* cited by examiner

*Primary Examiner* — Ismael Izaguirre
(74) *Attorney, Agent, or Firm* — Lee & Hayes, P.C.

(57) ABSTRACT

A device for providing support for a workpiece on an embroidery machine. The device has a base that is configured to fit on a rod of the embroidery machine, wherein the rod of the embroidery machine is located beneath a bobbin arm. First and second sides extend upward from the base and form a channel therebetween, the channel being configured to receive the bobbin arm of the embroidery machine. The first and second sides have upper edges that are configured to provide a support structure for a workpiece placed thereon, and preferably extend to a height that is substantially the same height as a top of the bobbin arm.

16 Claims, 6 Drawing Sheets

TOOL FOR SUPPORTING A WORKPIECE ON AN EMBROIDERY MACHINE

RELATED APPLICATIONS

The present application is a Continuation In Part application of commonly assigned patent application Ser. No. 17/549,507, entitled SYSTEMS AND METHODS FOR PACKAGING ARTICLES TO BE EMBROIDERED, filed Dec. 13, 2021 and hereby incorporated by reference, which in turn is a Continuation application of commonly assigned patent application Ser. No. 17/093,579, entitled SYSTEMS AND METHODS FOR PACKAGING ARTICLES TO BE EMBROIDERED, filed Nov. 9, 2020, now U.S. Pat. No. 11,198,963, issued Dec. 14, 2021.

FIELD OF THE INVENTION

The presently disclosed embodiments relate to garment manufacture and to a device for facilitating an embroidery process in an automatic manufacturing environment.

BACKGROUND

Embroidery is a technique for forming a decorative feature on an article using a needle to apply thread onto the surface of the article. The process may be used to decorate articles such as caps, tee-shirts, dress shirts, uniforms, athletic apparel, shoes, handbags, home furnishings, and related novelty items. In existing embroidery technology, articles to be embroidered are typically stored awaiting to be embroidered in a stacked or folded manner. The articles may be non-rigid, for example articles of clothing comprising fabric. In order to load the articles onto an embroidery machine, the non-rigid articles may be affixed to a two-part embroidery hoop. The process of affixing an article to the hoop may be performed manually.

In on-demand embroidery settings, for example at a mall kiosk, the step of affixing the embroidery hoop to the article and connecting it to the embroidery machine is labor intensive and involves both time and skill in orienting and aligning the hoop so that the embroidered design is properly placed onto the article by an embroidery machine.

SUMMARY

The present embodiments provide a tool for use with an embroidery machine, the tool includes a base configured to attach to a rod of the embroidery machine, and first and second sides extending upward form the base. The first and second sides form a channel there-between, the channel being configured to receive a bobbin arm of the embroidery machine. The first and second sides have upper edges that are configured to provide a support structure for a workpiece.

In one embodiment, the channel can be configured to loosely engage the bobbin arm. In one embodiment, the upper edges of the first and second sides can be configured to extend to a height that is substantially a height of a top of the bobbin arm of the embroidery machine.

In one embodiment, the tool can also include a rear shaft collar, a front shaft collar and a compression spring. The rear shaft collar and the front shaft collar can be configured to fit around and engage a rod of the embroidery machine, and the compression spring can be configured to fit around the rod. In one embodiment, the tool can be configured such that the compression spring can be located between the base and the rear shaft collar and can be configured such that the compression spring and the base can fit between the rear shaft collar and the front shaft collar.

In one embodiment, the channel defined by the first and second sides can have open front and back ends. In one embodiment, the base can be configured to fit on a rod that is located beneath the bobbin arm of the embroidery machine.

These and other features and advantages will be apparent to one of skill in the art upon reading of the following detailed description of the embodiments in conjunction with the figures. In the figures, like reference numerals used in more than one figure indicate a like element and may be considered in light of the description of the like element presented in any of the other figures having the like element.

BRIEF DESCRIPTION OF THE DRAWINGS

For a fuller understanding of the nature and advantages, as well as the preferred mode of use, reference should be made to the following detailed description read in conjunction with the accompanying drawings. The drawings are not presented to scale unless specified otherwise on an individual basis.

DETAILED DESCRIPTION

The following description includes the best embodiments presently contemplated for carrying out the embodiments. This description is made for the purpose of illustrating the general principles and is not meant to limit the inventive concepts claimed herein in any way.

Figure 1:
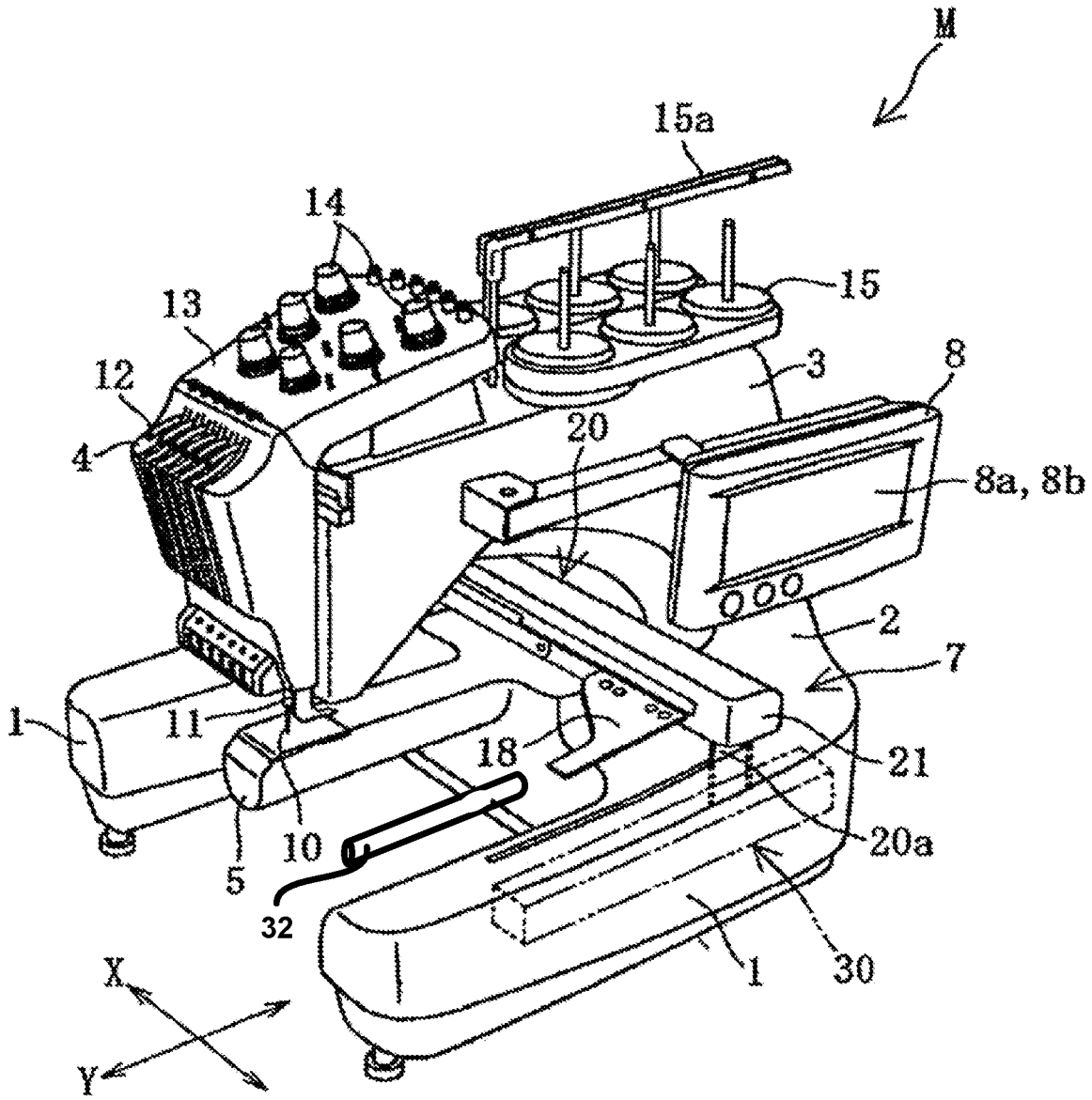
FIG. 1 (PRIOR ART)
FIG. 1 is a perspective view of an embroidery machine according to the prior art.

FIG. 1 is a perspective view of an example of an embroider machine M according one possible prior art configuration. The embroidery machine M is shown to illustrate a possible environment in which one or more embodiments might be implemented. The embroidery machine M can include a bifurcated support leg 1, a sewing arm 3 extending frontward from an upper end of the pillar 2 and a needle-bar case 4, which can be attached to a distal end of the arm 3 so as to be movable in the right-left direction. The sewing machine M may further include a bobbin arm 5 having a bobbin formed therein, extending frontward from a lower end of the pillar 2, and a cloth-holder frame transfer apparatus 7. An operation panel 8 can be provided, further including a display **8*a* operated by an operator so that various pieces of information can be entered and a touch panel 8*b***, to control the overall multi-needle swing machine M.

Needle-bars 11 can be attached to the needle-bar case 4. The needle-bars 11 can have lower ends on which sewing needles 10 can be mounted and can include thread take-ups 12 corresponding to the needle-bars 11. The needle-bars 11 and thread take-ups 12 can be placed side by side in the right-left direction. A reverse sewing lever plate 13 can be provided on an upper end of the needle-bar case 4 so as to protrude to the front half side of the arm 3. Thread tensioners 14 can be attached to the reverse sewing lever plate 13. Thread spool stands 15 can be disposed on the rear half of the arm 3. A thread guide bar 15*a* can be provided over the thread spool stands 15. Thread spools can be settable on the thread spool stands respectively. Needle threads extending from the set thread spools can be supplied through the thread guide bar 15*a* and the thread tensioners 14, thread take-ups 12 and the like to the sewing needles 10.

The frame 7 includes an X carriage driving mechanism 20, which can move a workpiece holder 18 in an X direction. The frame 7 can also include a Y carriage mechanism which can move the workpiece holder 18 in a Y direction. The Y carriage driving mechanism 30 can be enclosed in the support leg 1 and can be constructed so as to support the X carriage driving mechanism 20 and the movable case 21. The Y carriage driving mechanism 30 can include a pair of guides supporting a pair of legs 20*a* each extending downward from a frame of the X carriage driving mechanism 20 respectively.

With continued reference to FIG. 1, the embroidery machine M can also include a device such as a rod 32, which can facilitate the embroidery of three-dimensional objects such as caps. The rod 32 can hold such an item while also allowing it to be moved or rotated about the rod 32 during an embroidery process.

The above description is merely one example of a possible embroidery machine that can be used to embroider any of items such as garments caps bags, etc. This is, however, by way of example, in order to illustrate the challenge of using such a machine in a fully or partially automated system and for illustrating a solution to such challenges. For example, as can be seen in FIG. 1, in order to perform an embroidery process, a workpiece (not shown) must be mounted to or otherwise connected with the workpiece holder 18. Often this can involve installing a fabric or similar material to an embroidery hoop (not shown) and connecting that embroidery hoop to the workpiece holder 18. The process of hooping the relevant area of the garment to be embroidered, under the correct tension, and using the proper backing material requires a significant amount of manual skill and dexterity. In some embodiments, a pre-hooped garment packaging may be used to eliminate or reduce much of the required manual dexterity and skill of an operator. The pre-hooped garment packaging may be positioned under the embroidery machine M using a robot. However, a robotic tool may have limitations of movement and dexterity because of the crowded space under the embroidery machine M. Thus, it would be difficult for a fully automated robotic system to operate in conjunction with a traditional embroidery machine M.

Figure 2:
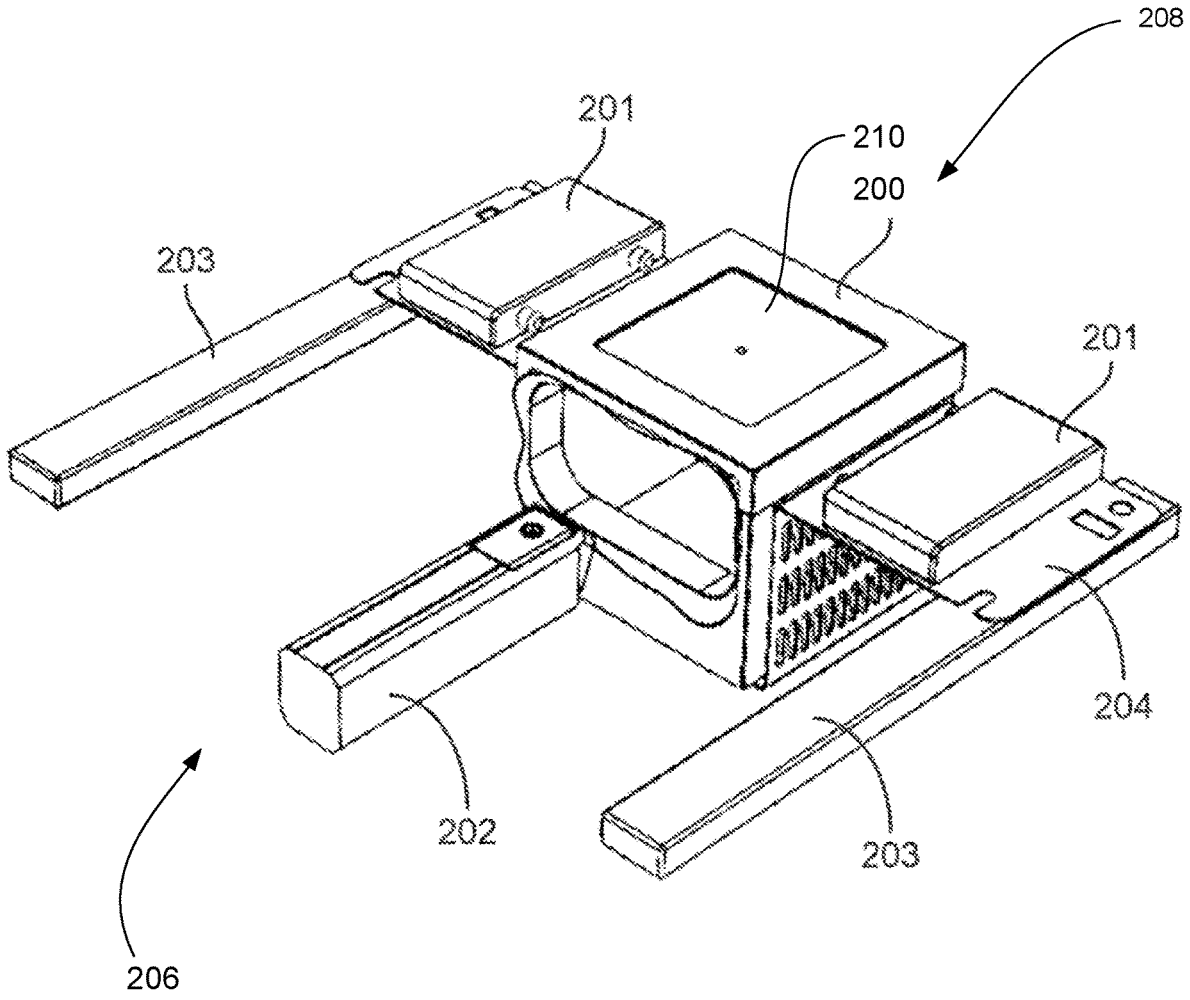
FIG. 2 is a perspective view of a portion of an embroidery machine and garment holder.

FIG. 2 illustrates a portion of an embroidery machine according to another embodiment. Arrow 208 indicates a back end of the embroidery machine, and arrow 206 indicates a front end of the embroidery machine. This embodiment can be used to embroider articles retained in packaging 200 shown in the configuration of a box (or alternative configurations) which keeps the article 210 to be embroidered taut with the appropriate backing material in a pre-hooped configuration. The packaging 200 can be positioned automatically by robotic arm(s) or can be manually placed between grippers 201, attached to feeders 203 of the embroidery machine 200 with brackets 204. The grippers 201 can be configured to engage the packaging 200 to securely hold the packaging 200. Such a structure and system are disclosed in commonly assigned patent application Ser. No. 17/093,579, entitled SYSTEMS AND METHODS FOR PACKAGING ARTICLES TO BE EMBROIDERED, filed Nov. 9, 2020, which is incorporated herein by reference.

Figure 3:
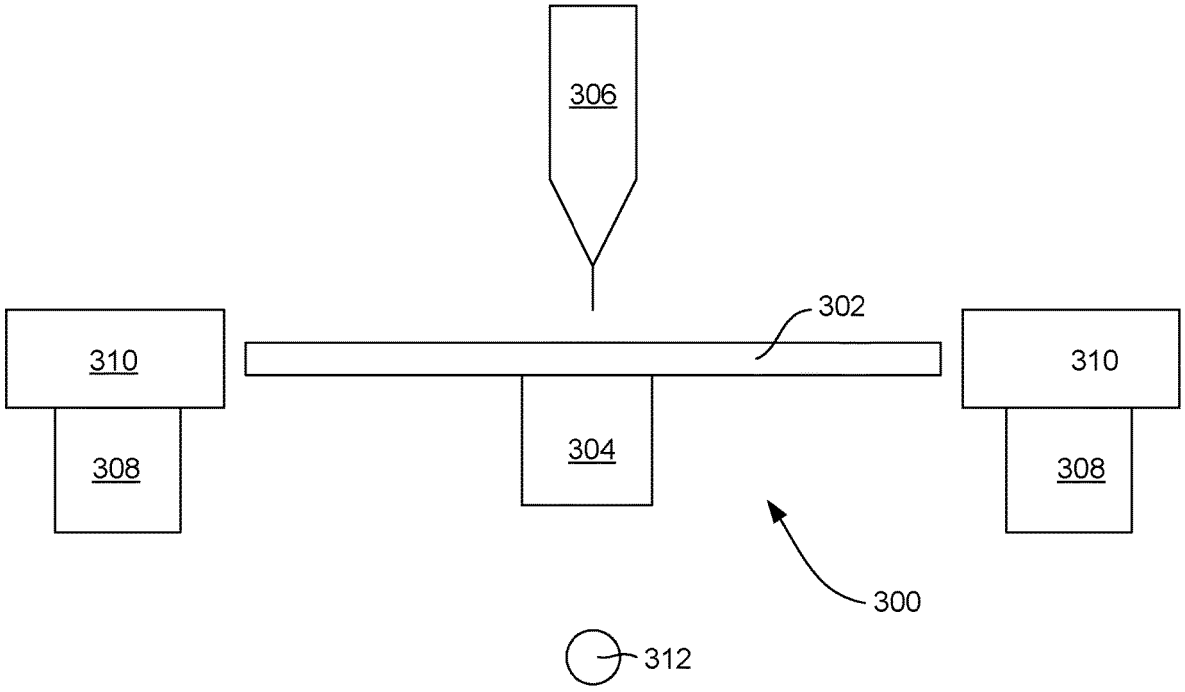
FIG. 3 is an end view of a portion of an embroidery machine and garment workpiece.

FIG. 3 shows an end view of a portion of an embroidery machine 300 and workpiece 302 to be attached to the embroidery machine 300 and on which embroidery can be performed. The workpiece 302 can be, for example, an embroidery hoop or similar device, and in another embodiment, the workpiece 302 can be a box 200, such as described above with reference to FIG. 2. In one embodiment, the embroidery machine can include grippers 310 which can be configured to grip and hold the workpiece 302 during the embroidery process. In one embodiment, the grippers can be similar to the grippers 201 previously described with reference to FIG. 2. As can be seen in FIG. 3, the workpiece 302 must be held in place while the grippers 310 move inward to grip the workpiece. This can be difficult to do in an automated manner with no manual operator to hold and properly position the workpiece 302 while the grippers are engaging the workpiece 302. The embroidery machine 300 can include a bobbin arm 304 and a needle 306. A workpiece holder or gripper 310 can be mounted to rails 308 that can be configured to move workpiece 302 in two dimensions in a horizontal plane, left to right as shown in FIG. 3. The embroidery machine 300 may also include a rod 312 for performing an embroidery process on a three-dimensional object such as a cap (as previously described).

Figure 4:
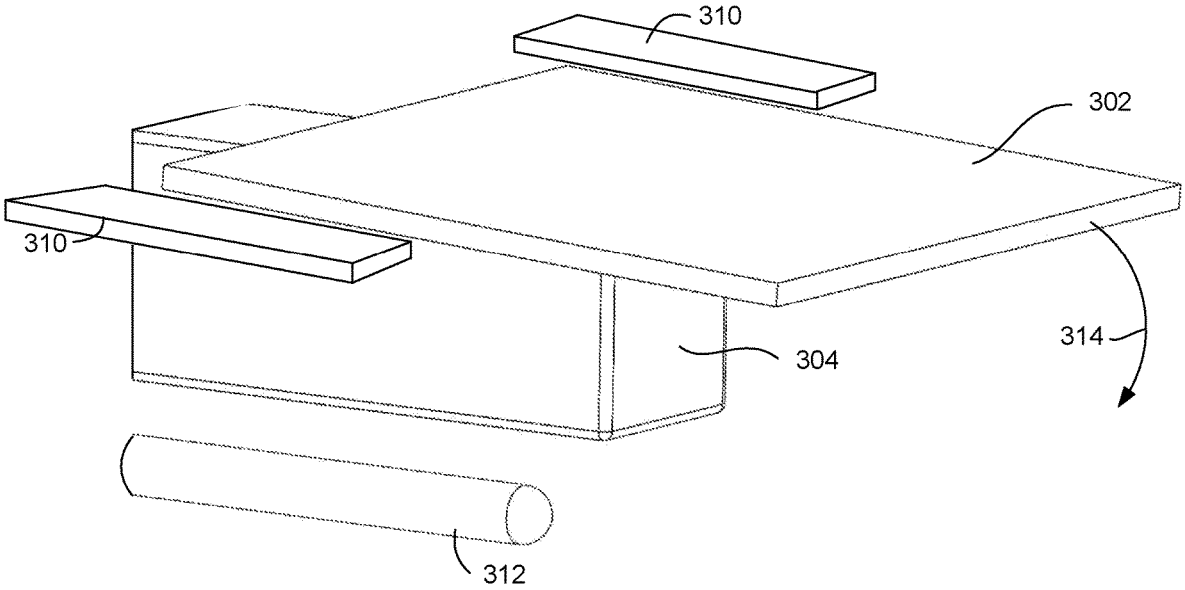
FIG. 4 is a perspective view of an embroidery machine and garment workpiece.

The previously described challenge that arises when mounting the workpiece 302 onto an embroidery machine can be better understood with reference to FIG. 4. FIG. 4 is a perspective view of the workpiece 302 in relation to the bobbin arm 304, rod 312 and workpiece holder 310. As can be seen in FIG. 4, the workpiece 302 may extend significantly past the bobbin 304 and workpiece holders 310. This may be necessary to allow the range of motion necessary to perform the embroidery process. Ideally, in an automated system it would be desirable that the workpiece 302 be accurately supported on a flat, stable surface while the grippers 310 connect with the workpiece 302. This would require less dexterity and accuracy in an automated system such as a robotic system. However, as can be seen, the workpiece 302 may extend significantly beyond the end of the bobbin arm 304 and beyond the lateral sides of the bobbin arm 304. This means that the workpiece cannot securely rest upon the bobbin arm 304 as it can tip over as indicated by arrow 314, either to the sides or over the end of the bobbin arm 304.

Figure 5:
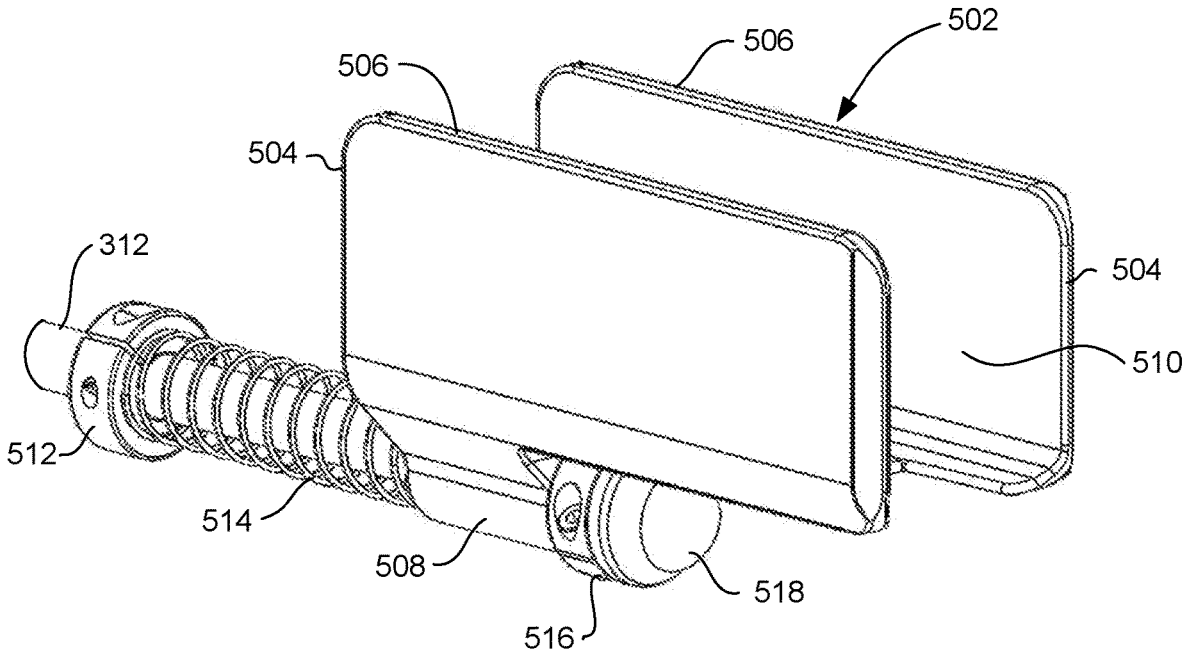
FIG. 5 is a perspective view of a workpiece support for use with an embroidery machine.
Figure 6:
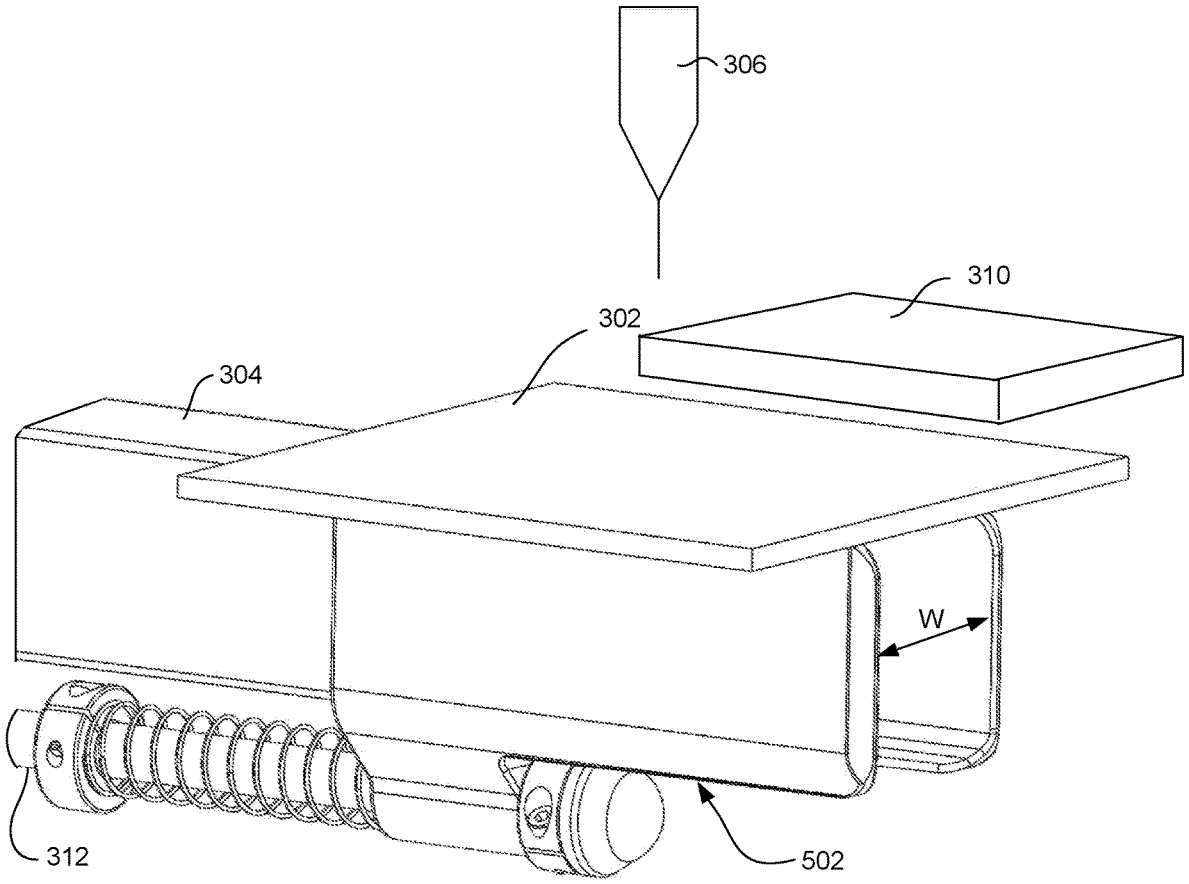
FIG. 6 is a perspective view of a workpiece support mounted on a portion of an embroidery machine and supporting a workpiece.

FIGS. 5 and 6 illustrate a tool 504 that can support the workpiece 302 in a stable manner prior to securely fastening the workpiece 302 to a workpiece grippers 310 (FIGS. 3 and 4). In some embodiments, the tool 504 can be easily mounted on a rod 312 of an existing embroidery machine. If the embroidery machine does not already include such a rod 312, such a rod can be added or connected to the main body of the embroidery machine directly. Providing a stable surface for supporting the workpiece 302 prior to engaging the grippers 310, greatly facilitates automation of the embroidery process.

FIG. 6 shows the tool 502 in relation to the bobbin arm 304 and with a workpiece 302 resting on top of the tool 502. FIG. 5 shows the tool 502 without the bobbin arm 304 or workpiece 302 so as to better illustrate the tool itself. In one embodiment, the tool 502 has first and second sides 504 that extend upward terminating at edges 506 that are configured to provide a stable support for the workpiece 302. In one embodiment, the sides 504 extend upward from a base 508 that is configured to fit onto the rod 312.

As discussed above, in one embodiment, the workpiece 302 can be configured as a box such as the box 200 of FIG. 2. In that case, the workpiece 302 would have sides that extend downward, such that the bobbin arm extension tool 502 can pass through the box. In FIG. 6 such downward facing walls of the workpiece 302 (e.g box 200) are not shown in order to more clearly show the bobbin arm extension tool 502 and bobbin arm 304. In addition, In FIG. 6, only one of the grippers 310 is shown, the opposite gripper 310 has been removed in order to more clearly illustrate the bobbin arm extension tool 502 and bobbin arm 304.

The first and second sides 504 are configured to define a channel or opening 510 therebetween. The channel 510 can be configured to allow the bobbin 304 to extend through the channel 520. In one embodiment, the channel 510 has a width W that allows a loose but engaging fit with the sides of the bobbin arm 304. This can prevent the bobbin arm extension tool 502 from twisting on the rod 312. In alternative embodiments, the channel 510's width is broad enough not to provide an engaging fit with the sides of the bobbin arm 304. The channel 510 provides an upper opening that provides an ingress for the needle 306 to extend through the fabric of the workpiece 302 to access the bobbin formed in the bobbin arm 304.

In one embodiment, the bobbin arm extension tool 502 can include a rear shaft collar, a compression spring 110, and a front-end shaft collar 516. An optional end cap 518 can be provided to prevent a garment from snagging on the end of the rod 312 and front-end shaft collar 516. The rear shaft collar 512 can be attached to the rod 312. The rear shaft collar 516 stops the compression spring 514. The compression spring 514 pushes against the base 508 of the bobbin arm extension tool 502, thereby pushing the bobbin arm extension tool 502 toward the end of the rod 512. The front-end shaft collar 516 prevents the bobbin arm extension tool 502 from falling off the rod 312 and defines the forwardmost position of the bobbin arm extension tool 502. The spring 514 allows the bobbin arm extension tool 502 to move with a workpiece 302 during the embroidery process, thereby ensuring that the workpieces is fully supported during the embroidery process. This ability of the bobbin arm extension tool 502 to move forward and back along the rod 512 can be especially advantageous in an embroidery configuration such as described above with reference to FIG. 2, wherein the workpiece is configured as a box 200 having a back end opposite the bobbin arm 202 of FIG. 2.

The tool 500 as described above provides a stable platform for a workpiece during mounting of the workpiece on an embroidery machine. This greatly facilitates the installation of the workpiece 302 by robotic or other automated means eliminating the need for complex, accurate manipulation of the workpiece during manufacture. This tooling 500 can be beneficial with either a flat workpiece as described with reference to FIGS. 3, 4 and 6 or with three-dimensional packaging such as described with reference to FIG. 2.

While various embodiments have been described above, it should be understood that they have been presented by way of example only and not limitation. Other embodiments falling within the scope of may also become apparent to those skilled in the art. Thus, the breadth and scope should not be limited by any of the above-described exemplary embodiments, but should be defined only in accordance with the following claims and their equivalents.

What is claimed is:

1. A tool for use with an embroidery machine, the tool comprising:

a base configured to attach to an embroidery machine;

first and second sides extending from the base and defining a channel therebetween and having edges configured to provide a support structure for a workpiece to be embroidered, the channel being configured to allow a bobbin arm of the embroidery machine to pass therethrough; and a rear shaft collar, a front shaft collar and a compression spring, wherein the rear shaft collar and the front shaft collar are configured fit around and engage a rod of the embroidery machine, and the compression spring is configured to fit around the rod of the embroidery machine.

2. The tool as in claim 1 wherein the channel is configured to loosely engage a bobbin arm of the embroidery machine.

3. The tool as in claim 1, wherein the edges of the first and second sides are configured to extend in a vertical direction to a height that is substantially that of a top of the bobbin arm of the embroidery machine.

4. The tool as in claim 1, wherein the compression spring is configured to be located between the rear shaft collar and the base, and the base and compression spring are configured to be located between the rear shaft collar and the front shaft collar.

5. The tool as in claim 1, wherein the channel formed by the first and second sides has opening at front and back ends.

6. The tool as in claim 1, wherein the base is configured to fit on a rod that is located beneath a bobbin arm of the embroidery machine.

7. The tool as in claim 1, wherein the channel defined by the first and second sides has an open upper end to allow a needle of the embroidery machine to pass through.

8. The tool as in claim 1, wherein the base is configured to support the workpiece in a substantially horizontal configuration.

9. The tool as in claim 1, the rear shaft collar, the front shaft collar and the compression spring provide a mechanism for biasing the base in an extended position, while allowing movement of the base in a retracted position.

10. A tool for use with an embroidery machine, the tool comprising:

a base configured to be attached to the embroidery machine, the base configured to temporarily support a workpiece to be embroidered prior to embroidery machine grippers grabbing the workpiece;

the base having first and second sides configured to allow a bobbin arm of the embroidery machine to pass there-between; and a rear shaft collar; a front shaft collar; and a compression spring; wherein the compression spring is configured to fit between the rear shaft collar and the front shaft collar, and wherein the rear shaft collar and front shaft collar are configured to engage the center rod and the compression spring is configured to wrap around the center rod.

11. The tool as in claim 10, wherein the first and second sides form a support structure for horizontally supporting a workpiece thereon.

12. The tool as in claim 10, wherein the first and second sides are configured to extend upward to a height of a top of the bobbin arm.

13. The tool as in claim 10, further comprising a mechanism for biasing the base in an extended position on the center rod while also allowing the base to be retracted on the center rod.

14. The tool as in claim 10, wherein the compression spring is configured to be located between the rear shaft collar and the base, and at least a portion of the base is configured to be located between the compression spring and the front shaft collar.

15. The tool as in claim 10, wherein the first and second sides of the base define a channel having open front and back ends.

16. The tool as in claim 10, wherein the first and second sides of the base define a channel having an open upper portion configured to allow a needle of the embroider machine to pass there-through.

* * * * *